United States Patent [19]

Jentoft et al.

[11] 4,073,097

[45] Feb. 14, 1978

[54] ENERGY EFFICIENT SKYLIGHT CONSTRUCTION

[75] Inventors: Arthur P. Jentoft, York; Paul A. Couture, Emery Mills, both of Maine

[73] Assignee: Wasco Products, Inc., Sanford, Maine

[21] Appl. No.: 700,787

[22] Filed: June 29, 1976

[51] Int. Cl.[2] ..... E04B 7/18; E04B 1/62

[52] U.S. Cl. ..... 52/22; 52/97; 52/200

[58] Field of Search ..... 52/200, 309, 97, 718, 52/22

[56] References Cited

U.S. PATENT DOCUMENTS

| | | | |
|---|---|---|---|
| 2,982,054 | 5/1961 | Anderson | 52/200 X |
| 3,434,251 | 3/1969 | Kiekhaefer | 52/309 X |
| 3,473,276 | 10/1969 | Back et al. | 52/200 |
| 3,788,013 | 1/1974 | Veen | 52/200 |
| 3,934,383 | 1/1976 | Perry et al. | 52/200 |

FOREIGN PATENT DOCUMENTS

| | | | |
|---|---|---|---|
| 1,429,675 | 3/1976 | United Kingdom | 52/200 |

*Primary Examiner*—J. Karl Bell

[57] ABSTRACT

An energy efficient skylight construction. A skylight cover is secured by a frame to a curbing comprised of an insulating core, the interior and exterior surfaces of which are covered by non-combustible shields separated along the upper and lower surfaces of the curbing by a gap which serves as a "thermal break" between the highly conductive inner and outer shields. The frame is pierced by drain openings the exterior of which are covered by a filter type material such as foam or glass fibers that is both absorbtive of moisture and resistant to the passage of air. The frame is secured to the outward portion of the curbing and includes a flange extending inward across the gap between the shields, which serves as a gutter to collect condensation which drips off the glazing. The inward portion of the flange is covered with an insulating gasket which prevents condensation from forming on the flange and which prevents the warmer, more moisture laden, inside air from reaching the cold underside of the gutter flange or the edge of the outer skin. The core insulation is inserted, without adhesives, into the assembled inside skin, and then the exposed surface of the insulation is bonded to the inside surface of the outer skin.

22 Claims, 4 Drawing Figures

Fig. 1
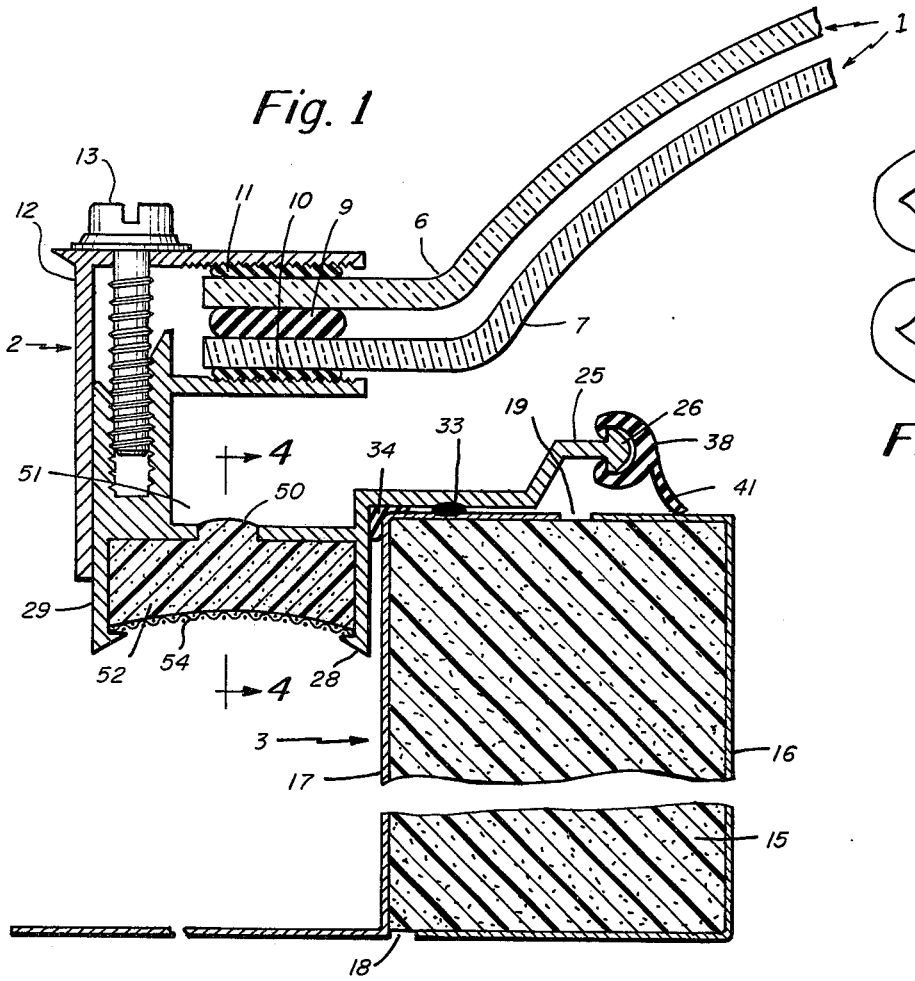
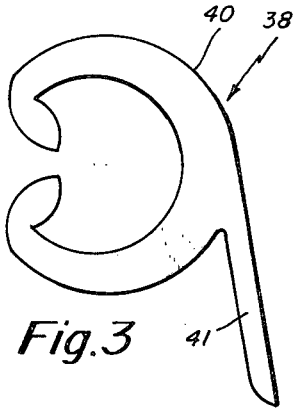
Fig.3
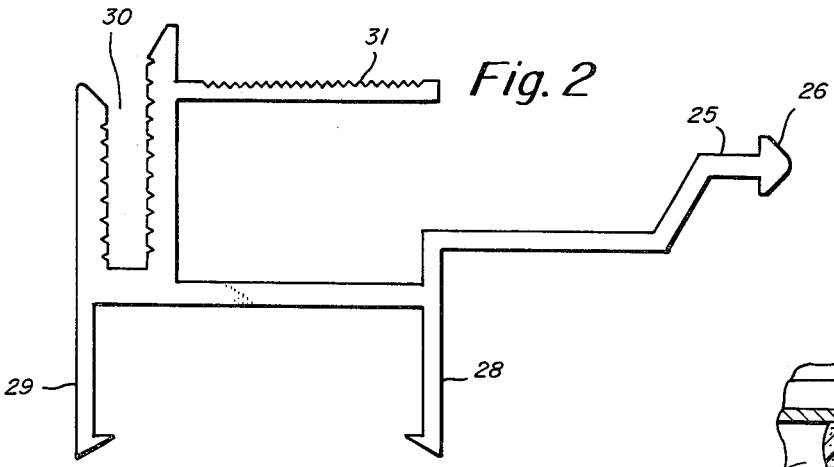
Fig. 2
Fig. 4
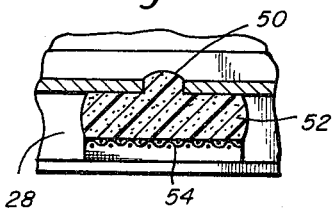

ENERGY EFFICIENT SKYLIGHT CONSTRUCTION

BACKGROUND OF THE INVENTION

The invention in general relates to skylight constructions used in buildings to provide daylight and more particularly concerns a skylight construction that is highly energy efficient while at the same time meets safety and quality requirements of both local and federal regulations.

Basically a skylight permits one to substitute daylight for electric light in a building. This obviously can provide a savings in lighting costs, however with conventional skylight designs this savings can be more than offset by increased heating costs due to thermal energy losses through the skylight. The current high cost of energy makes it very important to consider the overall energy balance of skylights. A recent study by the University of New Hampshire has indicated that in order for a skylight to consume less energy than the roof deck it replaces it must include (1) insulation in the curbing on which the skylight rests which approaches the effectiveness of the insulation of the roof, and (2) air infiltration approaching zero. Meeting such objectives in the design of skylights is not easy because skylights must also meet criteria for fire-resistance, shape, strength etc. imposed by federal and local regulations and functional requirements. For example urethane foam is an effective insulating material which because of low cost and rigidity lends itself to the construction of the curbing to which the skylight cover and frame is secured. However urethane foam also is a fire hazard, and therefore regulations require that it must be covered with a material such as aluminum; aluminum however, is thermally very conductive. Further, molded structural foams which are "self skinning" (i.e. no metal skin is required) have such high densities that they offer very poor resistance to heat loss, and they present a fire hazard. Other design materials that might theoretically solve the heating loss problem within the limitations set by the building codes are prohibitively expensive. Thus although energy efficiency has been a goal of skylight design for many years, until now competitive skylight constructions have not successfully solved the problem.

Accordingly it is an object of this invention to provide an improved skylight construction that overcomes one or more disadvantages of conventional skylight constructions.

It is a further object of this invention to achieve the preceding object with a skylight construction that is relatively energy efficient compared to conventional skylight constructions.

It is a further object of this invention to achieve one or more of the preceding objects in a skylight construction in which the curb insulation is nearly as effective as the insulation of the roof.

It is a further object of this invention to achieve one or more of the preceding objects in a skylight construction which reduces air infiltration nearly to zero.

It is another object of this invention to achieve one or more of the preceding objects with a skylight construction that meets code requirements for fire resistance.

It is a further object of this invention to achieve one or more of the preceding objects with a skylight construction that meets code requirements of shape, strength and like qualities.

It is a further object of this invention to achieve one or more of the preceding objects with a skylight construction that meets functional quality requirements.

It is a further object of this invention to achieve one or more of the preceding objects with a skylight construction that has a pleasing appearance.

It is a further object of this invention to achieve one or more of the preceding objects with a skylight construction that can be produced at a competitive price.

SUMMARY OF THE INVENTION

According to the invention there is a skylight construction for enclosing a building opening, of the type having a skylight cover secured to a curbing by means of a frame. The curbing comprises an insulating core, preferably highly energy efficient low density rigid urethane foam, the exterior and interior surfaces of which are covered by non-combustible shields separated along the upper and lower surfaces of the curbing by at least a small gap. Preferably the shields are aluminum and the top and bottom edges of the interior shield are break formed over the foam core to hold the shield in place. The frame is secured to the exterior shield of the curbing and includes a flange extending inward across the gap between the shields, which serves as a gutter to collect condensation from the glasing, and to direct it toward the weep holes. The inward portion of the flange is covered with a gasket whereby it is thermally insulated from the warm, relatively moist inside air.

The gasket extends downward to the interior shield thereby closing the gap which exposes the cold underside of the flange and the outside shield to the warm, relatively moist, inside air. Preferably the flange widens abruptly at its terminating edge to form a rim and the gasket comprises a C-shaped body which fits over the rim and which provides better insulation than a closely fitting gasket, and a downward and rearward projecting tail which closes the gap between the flange and the curb. The frame is pierced by drain openings which are covered by a filter material that is both absorbtive of moisture and resistant to the passage of air. Preferably the filter material has a relatively large exposed external area and is located on the exterior of the frame. Preferably a "weld through sealant" is used in the joint formed by the frame and curbing thereby sealing it when the preferred joining technique of spot welding is used. Numerous other features, objects and advantages of the invention will now become apparent from the following detailed description when read in connection with the accompanying drawings, in which:

BRIEF DESCRIPTION OF THE DRAWINGS

FIG. 1 is a diagrammatic cross sectional illustration of a portion of the preferred embodiment of the invention;

FIG. 2 is a cross sectional illustration of a portion of the preferred embodiment of the frame;

FIG. 3 is an enlarged cross sectional illustration of the preferred embodiment of the gasket; and FIG. 4 is a cross sectional view of the invention taken along line 4—4 of FIG. 1.

DETAILED DESCRIPTION OF THE PREFERRED EMBODIMENT

With reference now to the drawings and more particularly FIG. 1 thereof, there is shown a diagrammatic cross sectional illustration of a portion of the exemplary embodiment of the invention. Skylight cover 1 is secured by frame 2 to curbing 3. In the embodiment shown the skylight cover is a double set of acrylic domes 6, 7 separated by a layer of pre-molded butyl tape 9, and insulated from frame 2 by pre-molded butyl tape layers 10 and 11. In other embodiments of the invention the cover might be glass or other thermoplastic domes, thermosetting flat reinforced plastic (commonly called fiberglass panels), extruded plastic shapes, etc. In a cross sectional illustration of the complete invention domes 6, 7 would extend some distance to the right of FIG. 1 and the diagram shown in FIG. 1 would be replicated in reverse order at the far end of the domes. Domes 6, 7 are secured to frame 2 by retainer 12 held by screw 13. Curbing 3 comprises a highly energy efficient low density foam core 15 covered by interior aluminum shield 16 and exterior aluminum shield 17 which are separated along the upper and lower surfaces of curbing 3 by gaps 18 and 19. Foam core 15 typically would have a density of from 1.5 to 2 lbs. per cubic foot and the aluminum is of a thickness of, for example 0.025 inches to 0.032 inches. The edges of the interior shield may be break-formed over the foam to hold it in place. FIG. 1 shows one such securing technique wherein edge ridges 21 and 22 hold the shield 16 to the core 15. This eliminates the cost of the welds usually required to engage the interior shield to the exterior shield at the bottom. Also, this eliminates the cost and adverse appearance of the welds or fasteners usually required to join the interior shield to the frame. It should be noted that shields 16 and 17 could be replaced by a non-combustible foam surface or by rectangular, flat sheets of metal merely glued to the foam without departing from the concept of the invention.

Referring now to FIG. 2, there is shown a cross sectional illustration of a portion of the preferred embodiment of the frame. The frame comprises a flange 25, downward protecting legs 28 and 29, screw channels 30, and cover support 31. Flange 25 widens abruptly near its end to form a rim 26. The frame is composed of extruded aluminum in the preferred embodiment but may also be composed of extruded polyvinyl chloride plastic, extruded foam polyvinyl chloride plastic etc.

Returning now to FIG. 1, frame 2 is shown secured to the exterior shield 17 which covers the outer portion of curbing 3. In the preferred embodiment the frame is secured by a spot weld approximately at point 33 although alternatively it may be secured by pop rivets or other means. In the preferred embodiment a weld through sealant 34 is placed between the frame 2 and curbing 3 prior to spot welding. The pressure exerted by the spot welder compresses the sealant thus ensuring that air filtration will not occur at the joint formed by the frame and the curbing. Condensation gutter flange 25 extends inward across gap 19 and its inward portion is covered by gasket 38.

Referring now to FIG. 3 there is shown an enlarged cross sectional illustration of the preferred embodiment of the gasket 38, which comprises a C-shaped body 40, and a downward and rearward projecting tail 41. Gasket 38 is preferably composed of polyvinyl chloride weather strip molding.

Returning to FIG. 1, gasket 38 is shown to fit over flange rim 26. Gasket 38 and particularly gasket tail 41 closes the gap between the flange 25 and the interior shield 16 thereby preventing condensation from occurring on the underside of the flange or on the inner edge of the outside shield. The frame is first welded to the outside shield 17 at point 33 and then gasket 38 is engaged with the rim 26 of the frame. The frame is formed with a step near the rim end for permitting clearance of the gasket 38 and the tail 41 is sufficiently long to form a tight fit against the top surface of the shield 16. The insulating core is then placed in the inside shield. The inside surface of the outside shield 17 is then coated with adhesive, and the inside shield 16, with insulating core, is pushed in place until the top of the inside shield touches projecting tail 41 of gasket 38.

Drain openings 50 (see FIGS. 1 and 4) are regularly spaced along the frame 2 in order to discharge condensation water collected in frame gutter 51 to the outside. In accordance with the invention filter material 52, that is both absorbtive of moisture and resistive to the passage of air, is placed over the end of drain opening 50. In the preferred embodiment of the invention the filter material covers drain holes 50 and is held in place by rigid metal screen 54 attached to frame legs 28 and 29. Filter material 52 preferably is a fibrous material consisting of glass or plastic fibers which is designed to accommodate water passage over a long period of time. Flexible, low density open cell foam such as polyvinyl chloride, urethane, etc. can also be used when protected with a coating to permit continued exposure to water. An important feature of the invention is that this filter material absorbs the moisture from the condensation gutter 51 by capillary action, but provides a positive resistance to air filtration (out or in). Filter material 52 has a relatively large exposed external area to facilitate evaporation. FIG. 4 shows a view of the filter material taken through section 4—4 of FIG. 1 showing that in the preferred embodiment of the invention the filter material is exposed to the outer atmosphere on three sides and is retained by means of a screening.

The unique method of construction of the curbing described above is also an important feature of the invention. It eliminates conduction of heat through the metal from the inside to the outside of the curb. This enormously reduces heat losses and moreover, virtually eliminates the condensation which occurs on the interior walls of skylight units of conventional design.

The unique flange and gasketing arrangement is another important feature of the invention which contributes to the elimination of through metal conductivity, and also serves to improve the durability of the skylight construction. The gasket shields from condensation and heat pickup, not only the inside edge of the flange 25 but also the metal underside of the frame and the top edge of the exterior shield 17 which otherwise would be exposed to the interior air. In the invention urethane foam core 15 is glued to the shielding 17 (or alternative wall materials of the unit) as in convnetional designs but need not be bonded to shield 16. The unique flange and gasketing arrangement permits the collection of condensation water off the glazing while protecting the flange edge and underside from condensation.

All of the features of the invention described above work together to provide a thermally efficient skylight construction that can be produced at a competitive price.

There has been described a novel skylight construction that is energy efficient, meets code requirements for fire resistance, shape, strength, etc. and can be economically manufactured. It is evident that those skilled in the art may now make numerous uses and modifications of and departures from the specific embodiment described herein without departing from the inventive concepts. Consequently, the invention is to be construed as embracing each and every novel feature and novel combination of features present in or possessed by the apparatus herein disclosed.

What is claimed is:

1. In a skylight construction having a skylight cover secured to an annular curb assembly, said curb assembly including an annular heat insulating core having top, bottom and side wall surfaces, inner and outer fire shields comprising sheet means covering respectively the inner and outer side wall surfaces of said core, said inner and outer fire shields extending collectively about the core a distance less than the peripheral distance about the top, bottom and side wall surfaces of the core to thereby define a pair of gaps between ends of the shields for heat insulating the shields from each other, a frame means for supporting the skylight cover over the curb assembly including flange means cooperating with the curb assembly and support means at one end of the frame means for receiving and at least in part securing an edge of the skylight cover, said flange means resting upon the top surface of the curb assembly and having thermal conductive contact with only the outer shield.

2. A skylight construction in accordance with claim 1 wherein facing ends of said shields define the gaps along the top and bottom wall surfaces of said core.

3. A skylight construction in accordance with claim 1 including means coupled between the inner end of the flange means and the inner shield for heat insulating therebetween and applying pressure to the outer surface of the inner shield.

4. A skylight construction in accordance with claim 1 including means for bonding the core to the outer shield.

5. A skylight construction in accordance with claim 3 wherein said flange widens at its inner end to form a rim, and said means for heat insulating and moisture isolating comprises a C-shaped gasket which fits over the rim and has a downwardly and inwardly projecting tail which engages the outer surface of the inner shield.

6. A skylight construction in accordance with claim 1 wherein said frame has drain openings spaced thereabout and further comprising blocking means that is both absorbtive of moisture and resistant to the passage of air for covering the drain openings.

7. A skylight construction in accordance with claim 6 including means cooperative with the frame for holding the blocking means in place.

8. A skylight construction in accordance with claim 7 wherein said frame has two downwardly depending legs, one on either side of the drain opening, and said means for holding includes a screen means extending between the legs.

9. A skylight construction in accordance with claim 1 including sealant means between the frame and outer shield and weld means for securing the frame to the outer shield.

10. In a skylight construction having a skylight cover secured to an annular curb assembly, said curb assembly including an annular heat insulating core substantially encased by inner and outer fire shields comprising sheet means covering the core, a frame means for supporting the skylight cover over the curb assembly and including an inwardly directed flange means resting upon the curb assembly, means securing the flange to the curb assembly, and trough means defining spaced drain openings, and blocking means that is both absorbtive of moisture and resistant to the passage of air for covering the drain openings, said flange means resting on and in thermal conductive contact with only the outer shield.

11. A skylight construction in accordance with claim 10 including means for holding the blocking means in place.

12. A skylight construction in accordance with claim 11 wherein said blocking means comprises a filter material having an exposed external area much greater than the area of a drain opening.

13. A skylight construction in accordance with claim 11 wherein the frame has means for supporting the holding means for the blocking means.

14. A skylight construction in accordance with claim 13 wherein the supporting means includes a pair of legs, one on either side of the drain opening, and said means for holding includes a screen means extending between the legs.

15. A skylight construction in accordance with claim 11 wherein said holding means comprises downwardly directed legs of the frame means disposed on inner and outer sides of the drain openings, and screen means extending between the legs for holding the blocking means in place under the drain openings and between the legs.

16. A skylight construction in accordance with claim 10 wherein said frame means has a top member arranged over the trough means from which the cover is supported.

17. A skylight construction having a skylight cover secured to an annular curb assembly, said curb assembly including an annular heat insulating core substantially encased by inner and outer fire shields comprising sheet means covering the core, a frame means for supporting the skylight cover over the curb assembly and including an inwardly directed flange means resting upon the curb assembly, means securing the flange means to the curb assembly and trough means defining spaced drain openings, said frame means having a top member arranged over the trough means from which the cover is supported, said trough means being disposed outwardly of the curb assembly so that drainage occurs outside of the curb assembly.

18. In a skylight construction having a skylight cover secured to an annular curb assembly, a frame means for supporting the skylight cover over the curb assembly including flange means resting upon the curb assembly, support means at one end of the frame means for receiving and securing an edge of the skylight cover, and means disposed intermediate the ends of the frame means forming a trough for the collection and drainage of condensation from the cover, means for securing the flange means of the frame means to the curb assembly, and means cooperating with the support means for retaining the cover in place.

19. A skylight construction in accordance with claim 18 wherein said frame means has a step at least in part defining the trough and terminating in a free end, and gasket means having one side interlocked with the free end and another end bearing against the curb assembly.

20. A skylight construction in accordance with claim 19 wherein the gasket means is heat insulating and moist air isolating.

21. A skylight construction in accordance with claim 18 wherein said support means includes a platform extending over the trough, said trough having openings therein to permit water drainage.

22. A skylight construction in accordance with claim 20 wherein said retaining means comprises a retainer with the edge of the cover sandwiched between the retainer and platform.

* * * * *